United States Patent [19]

Pretchel

[11] Patent Number: 4,679,870

[45] Date of Patent: Jul. 14, 1987

[54] MANUFACTURE OF LOW PROFILE CLIP CONNECTOR

[75] Inventor: David A. Pretchel, Moreland Hills, Ohio

[73] Assignee: Minnesota Mining and Manufacturing Company, St. Paul, Minn.

[21] Appl. No.: 681,362

[22] Filed: Dec. 13, 1984

[51] Int. Cl.[4] ..... H01R 9/11; H01R 13/504

[52] U.S. Cl. ..... 439/493; 439/736; 439/871

[58] Field of Search ..... 339/17 F, 176 MF, 218 R, 339/218 M; 264/273

[56] References Cited

U.S. PATENT DOCUMENTS

| | | | |
|---|---|---|---|
| 3,274,533 | 9/1966 | Apted et al. | 339/218 M |
| 3,307,139 | 2/1967 | Prise | 339/176 MF |
| 3,851,294 | 11/1974 | Palazzetti et al. | 339/176 MF |
| 4,038,359 | 7/1977 | Pendleton | 264/273 |
| 4,294,789 | 10/1981 | Lincoln et al. | 264/273 |
| 4,547,028 | 10/1985 | Morgan et al. | 339/218 M |
| 4,596,428 | 6/1986 | Tengler | 339/17 F |

FOREIGN PATENT DOCUMENTS

| | | | |
|---|---|---|---|
| 1910241 | 9/1970 | Fed. Rep. of Germany | 339/218 R |

*Primary Examiner*—Eugene F. Desmond
*Assistant Examiner*—Gary F. Paumen
*Attorney, Agent, or Firm*—Renner, Otto, Boisselle & Lyon

[57] ABSTRACT

Manufacture of low profile clip connectors characterized by a cap in the form of a planar strip of plastic material provided with plural tapered holes spaced along its length. The cap is loaded into a test clip mold along with a cable/contact sub-assembly with the cap in juxtaposition with the side of the cable opposite the contacts which are soldered to respective conductors of the cable. After the mold is closed, molten plastic material is introduced into the mold cavity to form the balance of a clip body, the molten material flowing up through an insulation removed area of the cable around the soldered junctions and into the tapered holes in the cap which locks the cap to the thusly molded balance forming portion of the clip body.

12 Claims, 6 Drawing Figures

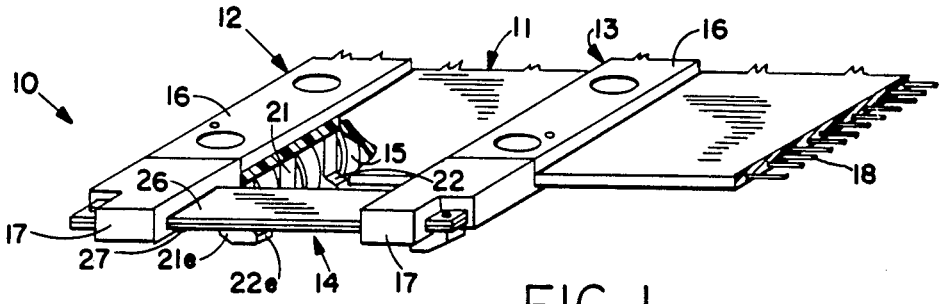
FIG. 1
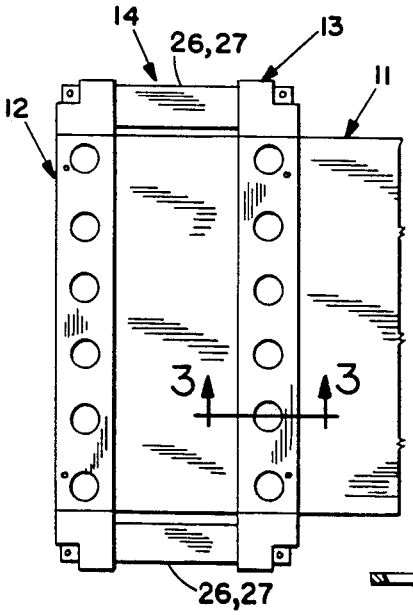
FIG. 2
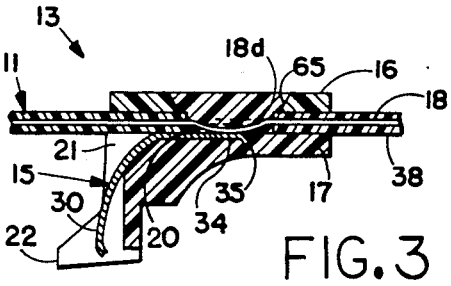
FIG. 3
FIG. 4
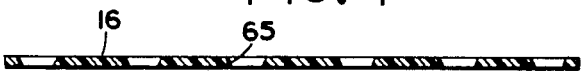
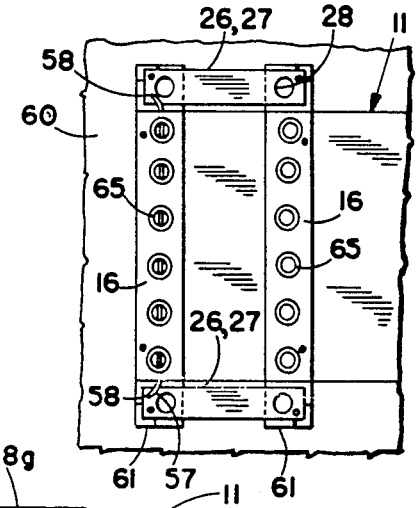
FIG. 5
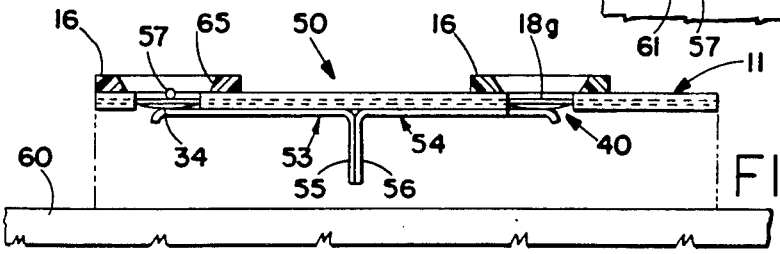
FIG. 6

MANUFACTURE OF LOW PROFILE CLIP CONNECTOR

DISCLOSURE

This invention herein disclosed relates generally to the manufacture of electrical connectors and more particularly to the manufacture of a low profile test clip of the type disclosed in Morgan et al copending U.S. patent application Ser. No. 539,121, filed Oct. 5, 1983 and entitled "Low Profile Test Clip", now U.S. Pat. No. 4,547,028, issued Oct. 15, 1985.

BACKGROUND

In the above identified U.S. patent application there is disclosed a low profile test clip which has particular application for interconnection with the input/output leads of an electrical component or device, such as an integrated circuit package, for the purpose of attaching test equipment to the leads thereof arranged in plural rows consisting of 14, 16, 32 or 40 leads for example. The test clip comprises an electrical cable of the flat or ribbon type including plural electrical conductors, a pair of low height clip bodies molded to the cable, each clip body including therein plural electrical contacts having exposed contacting portions for engaging the leads of the electrical device and a mounting portion about which the clip body is molded and which is electrically connected to a respective conductor of the cable at a portion thereof from which the cable insulation has been removed, and a coupling mechanism for coupling the pair of bodies with respect to each other for mounting of the test clip to the electrical device with respective electrical contacts engaged with respective leads of the device. The utilized coupling mechanism includes parallel leaf springs at respective lateral ends of the clip bodies to which the clip bodies are also molded.

Manufacture of such test clip heretofore was accomplished by first soldering the contacts to respective conductors of the cable at portions of the conductors from which the cable insulation had been removed to form a cable/contact sub-assembly. The sub-assembly was then placed along with the leaf springs into the cavity of a mold for molding of the clip bodies about respective portions of the cable and portions of the contacts with the soldered junctions being fully encapsulated by the clip bodies to provide a hermetic seal about the junctions. After the mold was closed, molten plastic material, from which the clip bodies were formed, would be introduced into the mold cavity to fill the same, this involving flow of the molten plastic material around the cable to provide clip body portions both above and below the cable.

In such prior manufacturing procedure, there was a problem of cable shifting when the plastic clip bodies were molded around the cable. That is, forced flow of the molten plastic material engaging a planar surface of the cable in the mold cavity would tend to shift or displace the cable from its desired intermediate spaced position between top and bottom surfaces of the mold cavity. Consequently, the cable would not be located properly in the molded clip bodies. The cable shifting problem necessitated the scrapping of a considerable number of the clips which added to the overall cost of manufacturing the clips.

SUMMARY OF THE INVENTION

The present invention eliminates the above discussed cable shifting problem by the use of separately molded plastic caps which become integral parts of respective test clip bodies upon subsequent molding of respective balance forming portions of the test clip bodies to the electrical cable. Each cap preferably is in the form of a planar strip of plastic or other suitable material provided with plural tapered holes spaced along its length. According to the method of the invention, the cap is loaded into the test clip mold along with the cable/contact sub-assembly with the cap in juxtaposition with the side of the cable opposite the contacts. After the mold is closed, molten plastic material is introduced into the mold cavity to form the balance of the clip body, the molten material flowing up through an insulation removed area of the cable around the soldered junctions and into the tapered holes in the cap which locks the cap to the thusly molded balance forming portion of the clip body. In operation, the cap forms what might be called an essentially rigid back stop for the cable to prevent shifting of the cable as the molten plastic is forced into the mold cavity. The cap also becomes an integral part of the test clip body forming the top center area of the clip body while the subsequently molded balance forming body portion forms the ends and bottom area of the clip body. Through elimination of the cable shifting problem, the invention also provides a test clip of greater uniformity, there being assurance that the cable is properly located in each clip body, i.e., the electrically non-conductive support portion of the test clip.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

BRIEF DESCRIPTION OF THE DRAWING

In the annexed drawing:

FIG. 1 is a partial isometric view, partly broken away in section, of a low profile test clip according to the invention;

FIG. 2 is a top plan view of the test clip of FIG. 1;

FIG. 3 is an enlarged partial sectional view through one clip body of the test clip of FIG. 1 taken substantially along the line 3—3 of FIG. 2;

FIG. 4 is a side elevational view of a cap used in the test clip of FIG. 1;

FIG. 5 is a top plan view of a cable/contact sub-assembly loaded into the bottom half of a mold along with a cap for each test clip body; and FIG. 6 is an end elevational view showing the caps positioned in relation to the cable/contact sub-assembly just prior to molding of the balance forming portions of the test clip bodies.

DETAILED DESCRIPTION

Referring now in detail to the drawing and initially to FIGS. 1 and 2, a low profile test clip manufactured in accordance with the invention is indicated generally at 10. The test clip 10 includes an electrical cable 11 and a pair of clip bodies 12 and 13 joined to the cable 11 at longitudinally spaced apart locations and to each other by a connector mechanism 14. Each clip body 12, 13 includes therein a plurality of electrically conductive contacts 15 and consists of a cap 16 and a balance forming body portion 17 which are both formed of electrically non-conductive material but separately molded. The contacts 15 preferably are so closely packed that connections thereof to conductors 18 of the cable, such as those of the illustrated flat ribbon cable, will not require any spreading of the cable conductors while on the other hand such contacts still will fit properly and conveniently onto an integrated circuit package or the like to engage electrically the respective leads thereof.

The clip bodies 12 and 13 preferably are identical but oppositely facing in relation to the longitudinal extent of the cable 11. Accordingly, only the clip body 13 will be described in detail such description, however, being equally applicable to the other clip body 12.

With additional reference to FIG. 3, the balance forming body portion 17 of the clip body 13 is directly molded in the hereinafter described manner to the mounting portion 20 of each contact 15, part of the connector mechanism 14, part of the cable 11 and the cap 16 to form a secure, strong integral structure of such components or portions thereof. Such balance forming body portion 17 includes a plurality of finger or wall-like separators 21 which function to separate respective relatively adjacent contacts 15, to protect the contacts from damage, to guide the clip body into proper position with respect to a row of leads on an integrated circuit package, and to hold the test clip on such package in cooperation with the other clip body 12 and the connector mechanism 13. For such purposes, and especially the latter two, jaw-like teeth 22 protrude from the bottom of each separator 21 principally to provide a gripping function with respect to an integrated circuit package. Preferably the separators 21*e* and teeth 22*e* at respective lateral ends of the group thereof, i.e., the separators and teeth most proximate the lateral ends of the clip body, are wider in lateral direction than are the other separators and teeth therebetween, such width being too great for insertion between a pair of leads of the integrated circuit package to prevent the test clip from being positioned in what might otherwise feel and even visually appear to be a proper position but actually is a mis-aligned position with respect to such leads. The other or intermediate separators and feet are of a narrower width so as to fit in the space between adjacent leads of an integrated circuit.

As is shown in the above identified U.S. patent application Ser. No. 539,121, which is hereby fully incorporated herein by reference, the overall height of the test clip 10 may be nearly equivalent to the height of an integrated circuit package. The ability to achieve such low profile configuration is more fully discussed in such application as are further particular details of the test clip not herein discussed.

The manner of installation and connection of the test clip 10 to an integrated circuit package is also discussed in such application as is the operation of the connector mechanism 14 which enables relative pivoting of the clip bodies 12 and 13 for installing the test clip onto an integrated circuit package. It however is noted here that a preferred connector mechanism 14 is comprised of two pairs of leaf springs 26 and 27, the leaf springs of each pair being stacked and located at each lateral end of the test clip. Each of the leaf springs 26, 27 has openings 28 (FIG. 5) at opposite ends thereof to enable material of the respective balance forming body portion 17 to be molded therethrough to anchor the springs in the balance forming body portion. The leaf springs of the connector mechanism are in or approximately in the plane of the cable 11, such contributing to the low profile of the test clip for use in confined environments.

The contacts 15 are relatively compliant to provide effective electrical connections with leads of an integrated circuit or other device even though the actual lead positions may not be located exactly according to specification. Each contact is intended to provide an electrical connection between a respective conductor 18 of the cable 11 and a respective lead of an integrated circuit package. For this purpose, each contact has in addition to the above indicated mounting portion 20 a contacting portion 30 for engaging a lead of the electrical device. The contacting portion 30 of each contact 15 preferably is smoothly curved or bowed over the major extent thereof to facilitate smooth sliding, wiping and bending thereof with respect to a lead of an integrated circuit package as the test clip is installed or removed with respect to such package. It also is noted that the cable 11 is secured in the clip bodies 12 and 13 to extend generally parallel to a printed circuit board or the like onto which the integrated circuit package may be mounted, thereby minimizing the space required for the cable and avoiding any need to bend or twist the cable in bringing it out from the test clip and integrated circuit package.

The mounting portion 20 of each contact 15 extends in a direction generally parallel to the cable 11 and the conductors 18 therein, Each mounting portion is connected at a soldered, welded or otherwise effected junction 34 to a respective cable conductor 18. At the end of the contact mounting portion is a downwardly turned or bent tab 35 provided to help secure or anchor the contact in the molded material of the repective balance forming body portion 17 and hence in the clip body 13.

As indicated, the cable 11 preferably is a flat ribbon type cable having plural electrical conductors 18 arranged in parallel positional relation and held so and in electrical isolation by the cable insulation 38. Such cable may be that commonly referred to as transmission line cable intended for high speed signal transmission wherein plural signal conductors are bounded on both sides thereof by respective ground conductors.

To form a junction connection 34 between a respective conductor 18, such as one of the signal conductors of the cable 11, and the mounting portion 20 of a contact 15, a portion of the insulation 38 is removed at an area of the cable, as indicated at 40 in FIG. 6, to expose the conductors. The particular conductor intended for connection is deformed slightly downwardly out of the major plane of the conductors therein, for example, as is shown at the deformed conductor portion 18*d* in FIG. 3. The junction connection 34 is completed by soldering together the deformed conductor portion 18*d* and the contact mounting portion 20, thereby forming a secure mechanical and electrical connection. Similarly, the other conductors that are to be connected to respective contacts are bent or deformed down out of the normal plane of the cable conductors for formation of respective junction connections with respective contacts by soldering. In this manner relatively close packing of the contacts and the conductors can be accomplished, and the contact spacing can be such that will conform to the spacing of the leads of the inegrated circuit package. Other conductors such as ground conductors 18*g* (FIG. 6), which are not to be connected to a respective contact, are not downwardly deformed in such manner and, therefore, are maintained out of connection with respective contacts or the conductors joined to such contacts.

Through this procedure, there may be formed a cable/contact sub-assembly generally indicated at 50 in FIG. 6. As further seen in FIG. 6, the contacts 15 in the sub-assembly 50 may remain supported by respective carrier strips 53 and 54 provided during formation of the contacts by die cutting the same from a sheet of material. Each carrier strip 53, 54 is bent to provide a respective handle 55, 56 which facilitates proper placement of the contacts relative to the conductors during the soldering operation to form the junctions and during the molding operation to form the balance forming body portions 17. The carrier strips may be identical but used in paired opposition with the handles abutting each other for effective proper positioning of the contacts in relation to the conductors 18 of the cable 11 for the soldering operation. To facilitate forming soldered connections at the junctions 34, the mounting portions 20 of the connectors at the area of connection to the conductors may have a coating of solder already placed thereon prior to assembly. After such assembly, heat, hot vapor, or other means may be employed to reflow such solder coatings to form soldered connections at respective contacts and conductors at the junctions 34.

If desired, all or selected ones of the ground conductors 18*g* may be electrically connected in common using a wire 57 as a grounding bus therefor. The grounding wire 57 may extend over the ground conductors 18*g* at the side thereof opposite the direction in which the signal conductors are deformed at 18*d* for connection to the contacts 15. If desired, the ground bus wire may be precoated with solder that may be reflowed using conventional techniques to form soldered connections with the ground conductors. Additionally, the grounding wire may be mechanically and electrically attached to the leaf springs 26 and 27 as is shown at 58 in FIG. 5.

After the cable/contact sub-assembly 50 has been assembled in the manner illustrated and described, the sub-assembly may be loaded into a test clip mold as by placement in the bottom half of the mold seen at 60 in FIGS. 5 and 6. In FIG. 6, the cavity walls corresponding to the sides of the balance forming body portions 17 to be molded to the sub-assembly as hereinafter described can be seen at 61. When the sub-assembly is in place, the caps 16 may then be loaded into the mold with each cap in juxtaposition with the side of the cable opposite the contacts and aligned with a respective row of junctions 34.

As seen in FIGS. 4–6, each cap 16 is in the form of a planar strip of plastic or other non-conductive material provided with plural tapered holes 65 spaced along its length. The length of the cap is substantially and preferably equal the width of the cable 11, the thickness of the cap substantially and preferably equals the desired space in between the cable and the top of the finished clip body 12, 13, and the width of the cap preferably corresponds to the desired width of the clip body at the upper portion thereof.

Each cap 16 is positioned in the mold such that the holes therein are located above and aligned with the respective area 40 of the cable from which insulation has been removed to permit formation of the junctions 34 between cable conductors 18 and contact 15. Also the smaller diameter ends of the tapered holes are positioned adjacent the cable 11 such that the holes taper outwardly moving away from the cable.

After the mold is closed, molten plastic material is introduced into the mold cavity to form the balance of each clip body 12, 13, the mold cavity being defined by the bottom mold part 60 and a top mold part (not shown). Preferably, the molten platic material is caused to flow up through the insulation removed area 40 of the cable 11 around the soldered junctions 34 and into the tapered holes 65 in the cap 16 which locks the cap to the thusly molded balance forming portion 17 of the clip body.

As will be appreciated, the cap 16 forms what might be called a backstop for the cable 11 to prevent shifting of the cable as the molten plastic is forced into the mold cavity. That is, the cap serves as a spacer between the cable and the corresponding or top wall of the mold. The cap also becomes an integral part of the test clip body 12, 13 forming the top center area of the clip body while the subsequently molded balance forming body portion 17 forms the ends and bottom area of the clip body and also fills the tapered holes 65 in the cap. By preventing the cable from shifting, the resultant test clips are of greater uniformity, there being assurance that the cable is properly located in each clip body.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

I claim:

1. In an electrical connector for an electrical device that has at least one row of electrically conductive leads, the connector including an electrical cable including plural electrical conductors having portions from which the cable insulation has been removed, at least one connector body of electrically non-conductive material molded to said cable at the insulation removed portions of said conductors, said connector body including therein plural electrical contacts each including an exposed contact portion for engaging a lead of the electrical device and a mounting portion about which said connecteor body is molded and which is electrically connected at a junction to the insulation removed portion of a respective conductor of said cable, and coupling means for removably attaching said connector body to the electrical device with respective ones of said electrical contacts engaged with respective leads of such device; and the improvement comprising as a part of said connector body a separately molded cap of electrically non-conductive material in juxtaposition with a side of said cable opposite said electrical contacts and coextensive with the insulation removed portions of said conductors, and locking means for locking said cap in said connector body upon subsequent molding of the balance of said connector body to at least a part of each of said cap, cable and contacts to form an integral structure therewith.

2. An improved connector as set forth in claim 1, wherein said locking means includes at least one aperture in said cap into which the material of said balance of said connector body flows upon molding of such balance of said connector body to said cable.

3. An improved connector as set forth in claim 2, wherein there are plural apertures spaced along the length of the cap each in the form of a tapered hole having its smallest end closest the cable.

4. An improved connector as set forth in claim 1, wherein junctions between said electrical contacts and respective conductors are spaced apart from said cap and encapsulated by said balance of said connector body.

5. An improved connector as set forth in claim 1, wherein said cap extends the width of the cable.

6. An improved connector as set forth in claim 1, wherein said cap is substantially planar having inner and outer surfaces, and said locking means includes plural tapered through holes in said cap with their smaller ends closest the cable, and said balance of said connector body has a portion thereof respectively molded in said holes operative to lock the cap to said balance of said connector body.

7. An improved connector as set forth in claim 6, wherein said portion of said connector body has an outer surface flush with said outer surface of said cap.

8. In an electrical connector for an electrical device that has plural rows of electrically conductive leads, the connector including an electrical cable having plural electrical conductors, a pair of connector bodies of electrically non-conductive material molded to said cable to respective locations along its length, each connector body including therein plural electrical contacts having an exposed contact portion for engaging a lead of the electrical device and a mounting portion about which the connector body is molded and which is electrically connected at a function to a respective conductor of said cable, and resilient means for coupling said connector bodies for relative pivoting-like movement to permit attachment of said connector to the electrical device with respective ones of said electrical contacts engaged with respective leads of such device; and the improvement comprising as a part of each said connector body a respective separately molded support means of electrically non-conductive material engageable with a surface of a mold cavity for supporting said cable and said electrical contacts connected thereto in proper position with respect to the mold cavity during molding of the balance of the connector body therein, and locking means for locking said support means in the connector body upon such molding of the balance of the connector body to at least a part of each of said support means, cable and contacts to form an integral structure therewith.

9. An improved connector as set forth in claim 8, wherein said locking means includes at least one aperture in said support means into which the material of said balance of the connector body flows upon molding of such balance of the connector body to the cable.

10. An improvement connector as set forth in claim 8, wherein said junctions between said electrical contacts and respective conductors are spaced apart from said support means and encapsulated by said balance of the connector body.

11. An improved connector as set forth in claim 8, wherein the support means extends the width of the cable.

12. An improved connector as set forth in claim 8, wherein said resilient means comprises a spring means for holding said connector bodies in a first relative relation and being resiliently yieldable upon application of force thereto to permit relative movement of said bodies to install or to remove the connector relative to the electrical device.

* * * * *

UNITED STATES PATENT OFFICE

CERTIFICATE OF CORRECTION

Patent No. 4,679,870 Dated July 14, 1987

Inventor(s) David A. Pretchel

It is certified that error appears in the above-identified patent and that said Letters Patent are hereby corrected as shown below:

Column 1, line 6, the first word "This" should read --The--.

In claim 8, line 11, "function" should read --junction--.

In claim 10, line 1, "improvement" should read --improved--.

Signed and Sealed this

Eighth Day of March, 1988

*Attest:*

DONALD J. QUIGG

*Attesting Officer*

*Commissioner of Patents and Trademarks*